United States Patent [19]

Caruth

[11] Patent Number: 4,674,387

[45] Date of Patent: Jun. 23, 1987

[54] TUNING KEY

[76] Inventor: John Caruth, 5001 LBJ Freeway, Suite 705, Dallas, Tex. 75244

[21] Appl. No.: 801,560

[22] Filed: Nov. 25, 1985

Related U.S. Application Data

[63] Continuation-in-part of Ser. No. 521,400, Aug. 8, 1983, abandoned.

[51] Int. Cl.[4] ..... G10D 3/14

[52] U.S. Cl. ..... 84/304; 84/208; 84/297 R

[58] Field of Search ..... 84/200–208, 84/297 R, 304–306, 312

[56] References Cited

U.S. PATENT DOCUMENTS

| | | | |
|---|---|---|---|
| 790 | 6/1838 | Walker | 84/205 |
| 17,812 | 7/1857 | Schilling | 84/205 |
| 366,782 | 7/1887 | Lutz | 84/206 |
| 605,043 | 5/1898 | Gittus | 84/206 |
| 3,830,132 | 8/1974 | Lowe | 84/304 |
| 4,026,182 | 5/1977 | Gilbrech | 84/305 |
| 4,452,120 | 6/1984 | Chance et al. | 84/306 |

*Primary Examiner*—Lawrence R. Franklin

*Attorney, Agent, or Firm*—Thomas L. Crisman; Stanley R. Moore

[57] ABSTRACT

A linear movement tuning key for the peg head of a stringed musical instrument. A key includes a generally cylindrical body portion having a radially extending flange at the upper end, upon which is mounted a guide roller having its axis generally coplanar with the body of an instrument string. The roller is adapted for receiving the string thereacross and rotating therewith for direct orthogonal transfer of string tensioning forces. A tuning piston is mounted within a central axial opening in the cylindrical body portion of the key with the lower inner portion of the axial opening being threaded to receive a screw actuation ram. The lower, outer portion of the key body is also threaded to receive a cylindrical mounting sleeve, the upper edge of bears against the under surface of the peg head to rigidly secure the key body portion within the peg head. The lower end of the screw actuator ram is rigidly fixed to the central inside portion of a knurled tuning knob which closely overlies and seals against the outer surface of the cylindrical mounting sleeve by means of a O-ring. An instrument string is then passed across the guide roller and clamped relative to the upper end of the tuning piston. In this manner, axial movement of the tuning piston imparts a direct tensioning force to the orthogonally disposed body of the instrument string by its frictional engagement with and movement around the guide roller.

13 Claims, 13 Drawing Figures

FIG. 6
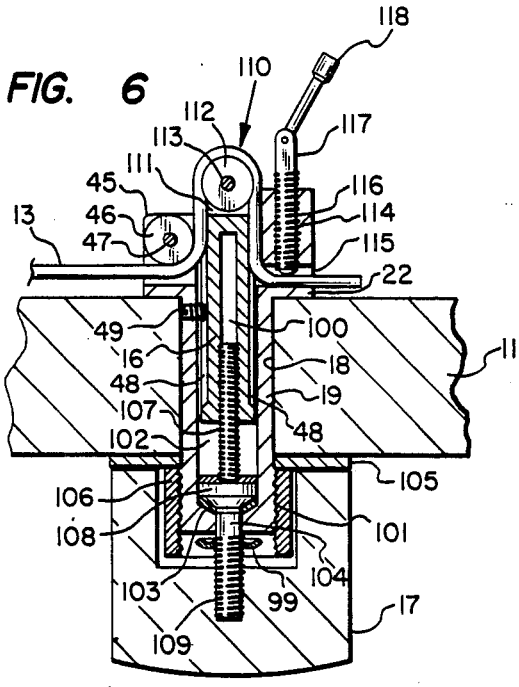
FIG. 7
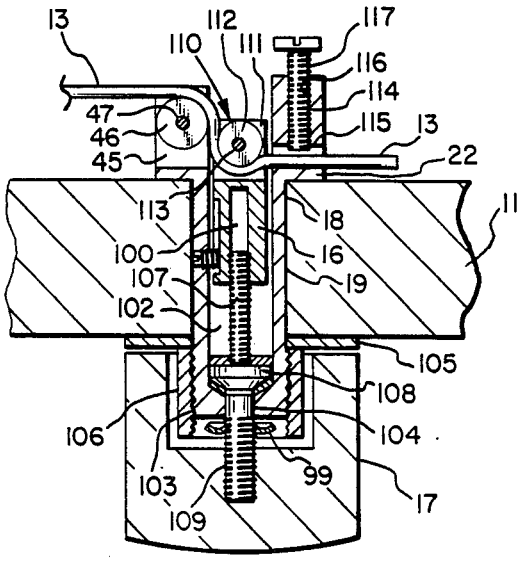
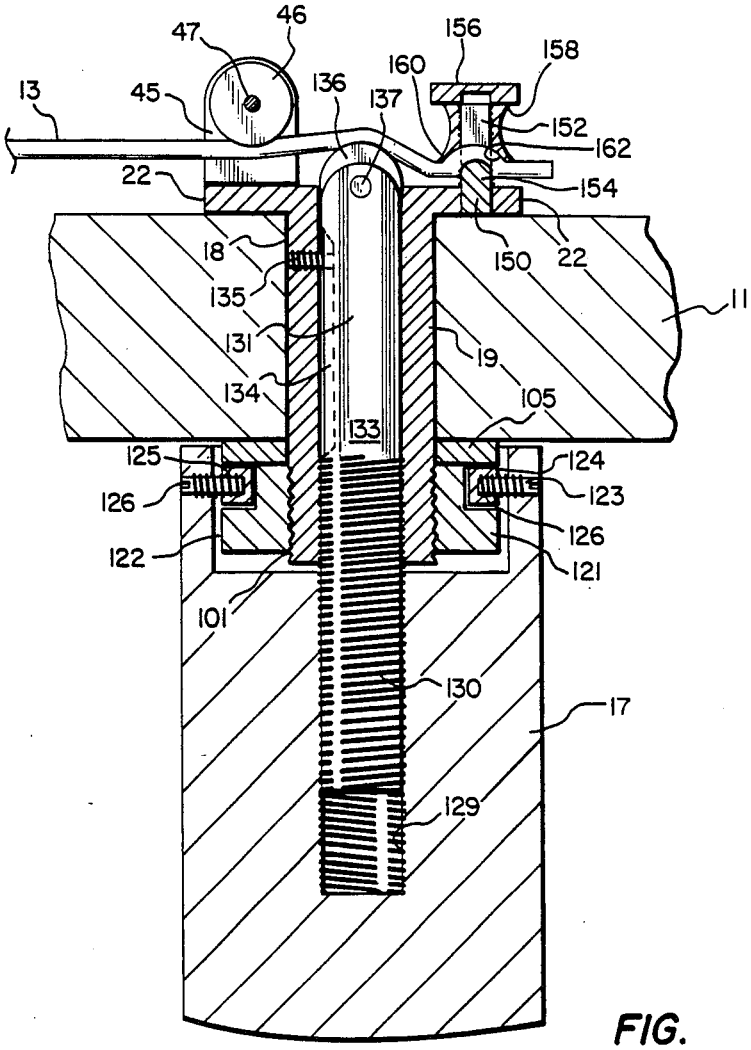
FIG. 8

TUNING KEY

Cross-reference to Related Application

This Application is a continuation-in-part of co-pending U.S. patent application Ser. No. 521,400, filed Aug. 8, 1983 abandoned.

BACKGROUND OF THE INVENTION

Field of the Invention

The invention relates to a linear tuning key for a stringed instrument, and more particularly, to an improved linear tuning key wherein the instrument string is directly tensioned across a guide roller through longitudinal movement of a tuning plunger in a direction generally orthogonal to the body of the string.

History of the Prior Art

Traditionally, stringed instruments such as guitars have been tuned by means of rotatable posts which extend through the peg head of an instrument and to which one end of a string is affixed and then wrapped about. In olden days a tuning post was friction fitted into a raw aperture in the peg head and the lower end of the post was provided with a grippable surface for tuning rotation of the post. More recently, tuning of the instrument is accomplished by rotating a knob which is mechanically connected to the tuning post by means of gear mechanisms so that the post is rotated to tension the string to the desired pitch. Such rotatable tuning posts have served well, however, they possess numerous inherent disadvantages. For example, there is a tendency for strings to slip or lose slight amounts of tension due to backlash in the gear mechanism. If the string is tuned slightly above the desired pitch and then brought back down to pitch, it is almost impossible to lower it to exact pitch due to backlash in the gear mechanism. Also, musical strings frequently consist not of a single strand of wire, but rather, a central core about which a second fine wire is spirally wrapped. When wrapped strings are wound about a tuning peg the portions thereof engaging the outer surface of the peg tend to flatten out and hence tension in the string is lessened and the instrument goes out of tune.

Improvements have been made in tuning pegs whereby the string is affixed to a post which is movable longitudinally and transversely to the plane of the instrument peg board. Tensioning an instrument string in this fashion eliminates deterioration due to repetitive relaxation and retuning to pitch. However, prior art tuning keys having posts of the axial movement type, such as shown in U.S. Pat. No. 3,830,132 to Lowe and U.S. patent application Ser. No. 231,818 entitled "Adjustable Tuning Peg and Device", now abandoned, have still possessed a number of distinct disadvantages. Prior art linear tuning keys require that an instrument string pass over a guide block in order to angularly displace the axis of the end of the string from the body of the string so that the string can be tensioned by axial movement in a direction at some angle to the axis of the main body of the string. For example, in Lowe the string is wrapped about the axially movable tuning post and then drawn downwardly at a right angle to the body of the string into a cylindrical recess in the key. The surface of the string then bears against and frictionally engages the rigid upper peripheral edge of the cylindrical recess as it passes across the edge and down into the recess. Such stationary bending contact maximizes the frictional forces which must be overcome to move and tension the string. Movement of a stationary string bent across the recess edge must first overcome the static coefficient of friction before the string can be tensioned. Because the static coefficient of friction is higher than the kinetic coefficient, the tensioning force is not uniform.

It is well known in the art that engagement of a wound string with the tuning key edge produces abrasion during movement of the string and will eventually weaken it to the point that it will break. In addition, the transverse windings on a wound string produce incremental movements of the string as the windings pass over the edge of engagement. Linear movement tuning keys of the type exemplified by Lowe also possess an additional disadvantage, which is overcome by the structure of the present invention. These prior art structures expose the screw threads to dirt, dust and other foreign particles which seriously hampers the precise movement of the screw actuated plungers and accelerates the process of mechanical wear. Also, the tuning key of the present invention, by virtue of its linear tuning design and avoidance of the necessity of actuation by a side mounted, paddle-shaped tuning handle, can be mounted anywhere on the peghead which is desired for various structural and aesthetic considerations.

The tuning key of the present invention overcomes many of the disadvantages inherent in prior art linear movement tuning keys by providing a tuning key with a sealed actuation system operable about a guide pulley for limited string abrasion and finer incremental variations for more exact tuning.

SUMMARY OF THE INVENTION

The invention relates to a tuning key for a stringed musical instrument incorporating longitudinal movement of a tuning plunger. More particularly, one embodiment includes a tuning key for a stringed musical instrument having a peg head with apertures therein.

One embodiment of improved linearly actuated tuning key for a stringed musical instrument is of the type having a reciprocating piston mounted for axial movement within an inner cavity of a cylindrical piston housing having a radially extending flange and being secured within the instrument peg head. The piston has an upper end protruding from an open end of the cavity with means to secure an end of an instrument string relative thereto and a lower end disposed within the cavity, wherein the improvement comprises a first guide roller rotatably mounted adjacent the open end of the piston housing and which is adapted for receiving the instrument string thereacross for the rolling transfer of tensioning forces to the instrument string relative to the upper end of the tuning piston to transform axial movement of said piston directly into axial tensioning of the instrument string.

A further embodiment of the tuning key comprises a generally cylindrical piston housing including an elongate inner cavity having a first open end with a radially extending flange and a second end having an opening and an exterior surface of which is threaded. A tuning piston is positioned for axial movement within the inner cavity of the piston housing and the piston has an upper end protruding from the flanged open end of the cavity, a lower end within the cavity and a threaded axial opening. An actuation ram has first and second ends, the first end being threaded and in engagement with the axial opening in the piston and the second end extends through the second end of said housing. A cylindrical mounting sleeve has internal threads in engagement with the threaded exterior of the second end of the housing to clamp the housing into an aperture in the instrument peg head between the radial flange of the piston housing and the upper edge of the mounting sleeve. A string guide pulley is journaled upon an axle mounted parallel to the radially extending flange of the piston housing to receive and rotationally guide an instrument string into engagement with the upper end of the tuning piston for direct transfer of tensioning forces therealong. Means are included for securing an end of the instrument string relative to the tuning piston wherein axial movement of the piston imparts movement of the string across the guide roller. A cap-like cylindrical tuning knob has an open end and a closed end with inner walls which overlap and closely receive the outer walls of the mounting sleeve, the central inner portion of the tuning knob is rigidly fixed to the second end of the actuation ram to rotate the ram and effect axial movement of the tuning piston for tensioning an instrument string coupled thereto without axial movement of the tuning knob.

One embodiment of the tuning key comprises a generally cylindrical piston housing including a cylindrical inner cavity having an open end with a radially extending flange and a closed end having a reduced axial threaded opening. The exterior surface of the closed end of the housing is also threaded. A cylindrical tuning piston is positioned for axial movement within the inner cavity of a cylindrical piston housing. The piston has an upper end protruding from the open end of the cavity with means to clamp an instrument string thereto and a lower end within the cavity. The piston also includes a longitudinally extending groove in an exterior surface. A drive screw is provided having an enlarged end positioned adjacent to the closed end of the inner cavity of the piston housing and a shaft portion in threaded engagement with the threaded walls of the reduced axial opening in the closed end of the cavity. A cylindrical mounting sleeve is provided having threads in engagement with the exterior of the closed end of the housing to clamp the housing into an aperture in the instrument peg head between the radial flange of the piston housing and the upper edge of the mounting sleeve. The outer surface of the sleeve includes a rectangular groove formed circumferentially thereabout. A string guide pulley is rotatably mounted on an axle parallel to the radially extending flange of the piston housing and mounted thereto to receive and guide an instrument string into clamped engagement with the upper end of the tuning piston without abrading the string. A cap-like cylindrical tuning knob incorporates an open end and a closed end with inner walls which overlap and closely receive the outer walls of the mounting sleeve. The central inner portion of the tuning knob is rigidly fixed to the end of the drive screw to rotate the shaft and move the enlarged end of the screw. Movement of the drive screw effects axial movement of the tuning piston for tensioning an instrument string affixed thereto. An O-ring is positioned within the rectangular circumferential groove in the mounting sleeve to seal against the inner walls of the tuning knob to seal the interior thereof and frictionally prevent accidental rotation of the knob.

BRIEF DESCRIPTION OF THE DRAWING

For a more complete understanding of the present invention and for further objects and advantages thereof, reference may now be had to the following description taken in conjunction with the accompanying drawing, in which:

FIG. 6 is a longitudinal cross-sectional view of a further embodiment of the tuning key of the present invention;

FIG. 7 is a longitudinal cross-sectional view of an additional embodiment of the tuning key of the present invention;

FIG. 8 is a longitudinal cross-section of an alternate embodiment of the construction of the tuning key of the present invention;

DETAILED DESCRIPTION

Figure 1:
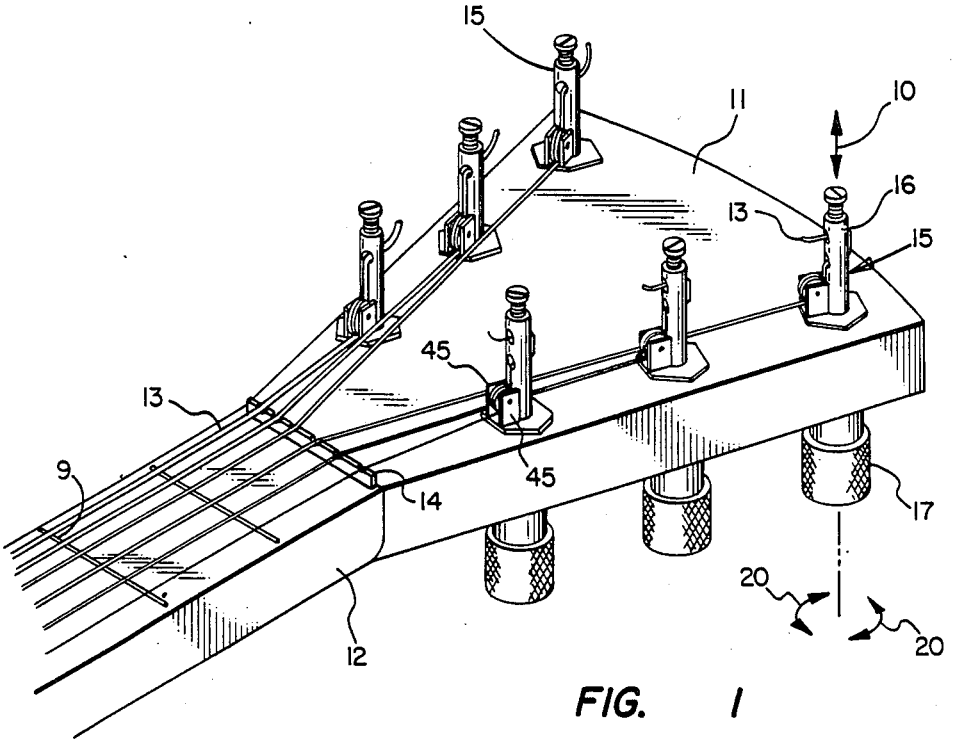
FIG. 1 is a perspective view of a stringed instrument peg head having a plurality of tuning keys constructed in accordance with the invention mounted thereon.
Figure 2:
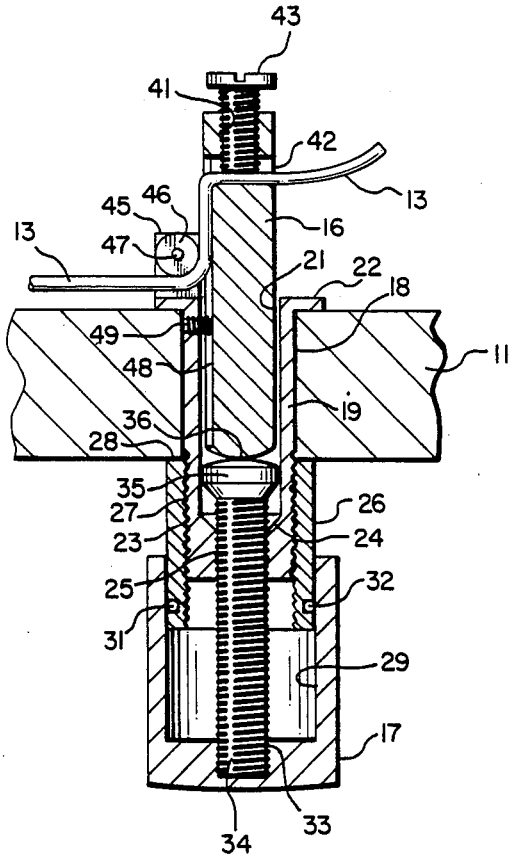
FIG. 2 is a cross-sectional view about a longitudinal axis of one of the tuning keys of the invention shown in FIG. 1.

Referring to FIG. 1, there is shown a perspective view of the peg head 11 and a portion of the fretboard of a string instrument such as a guitar. The peg head 11 mounts six tuning keys, each of which are constructed in accordance with the teachings of the present invention. The three linearly arranged lower keys are particularly adapted for use with single filament strings whereas the three upper keys are especially adapted for use with strings of the wound type. The peg head 11 includes a flat wedge-shaped portion, the smaller end of which is connected to the neck piece 12. Along the neckpiece and over the frets 9 are disposed a plurality of strings 13 which pass across a notched string guide 14 and are attached to respective ones of the tuning keys 15. Each key 15 includes a tuning piston 16 which is axially movable in the direction of arrow 10 and to which the strings are affixed. A tuning knob 17 is rotatable in the direction of arrow 20 to operate the piston 16 as will be presently discussed. Referring now to FIG. 2, the peg board 11 includes a circular aperture 18 extending therethrough and within which is positioned a cylindrical piston housing 19. The housing has a cylindrical inner chamber 21 with a radially extending flange 22 surrounding the open first end. The flange 22 extends radially outwardly and its lower surface is positioned flush against the upper surface of the peg board 11. The second end of the piston housing 19 includes threaded cylindrical outer walls 23 and an inner conical transition region 24 which narrows and closes the lower end of the inner chamber to a smaller threaded cylindrical opening 25. A mounting sleeve 26 has a threaded cylindrical interior 27 which engages the external threads 23 on the piston sleeve 19. The piston sleeve 19 is rigidly held within the peg board by tightening the sleeve 26 upon the threads 23 to grip the upper and lower surfaces of the peg board 11 between the lower surface of the radial flange 22 and the upper edges 28 of the sleeve 26. The cap-like tuning knob 17 includes a smooth cylindrical inner wall 29 which closely receives the smooth cylindrical outer wall of the mounting sleeve 26. The outer surface of the mounting sleeve 26 includes a circular groove 31 having a rectangular cross-section within which an O-ring 32 is received. The O-ring 32 is formed of resilient material and seals against the inside surface of the tuning knob 17 to prevent entry of dirt and other particles into the threaded working mechanisms of the tuning key. Friction between the O-ring and the interior of the tuning knob also prevents accidental tuning changes induced by vibration. The inside end surface of the tuning knob 17 includes a threaded cylindrical socket 33 which is fixed to one end of a screw threaded actuation ram 34. The ram 34 may also be permanently and rigidly affixed to the aperture 33 by means of epoxy or some other permanent attachment. The ram 34 may include either right or left handed thread as preferred by the individual musician.

The threaded portion of the actuation ram 34 is cylindrical with an enlarged head 35 at one end having a rounded upper surface 36 which engages a rounded lower surface of the base of the tuning piston 16. The pitch of the threads formed along the cylindrical outer surface of the actuation ram 34 determine the tuning ratio of the tuning key, that is, the number of revolutions of the tuning knob 17 required in order to effect a given quantum of tensioning in a string. The threaded outer surface of the actuation ram 34 engages mating internal threads 25 at the closed end of the piston chamber 21.

The tuning piston 16 is cylindrical with a generally smooth outer surface terminated at the lower end by a rounded portion 36 and a threaded axial opening 41 at the upper end. A diametrically transverse string aperture 42 intersects the bottom of the axial opening 41 for receiving a string 13. A set screw 43 engages the threaded opening 41 to clamp the string rigidly to the piston 16. An axially extending peripheral groove 48 is formed in the surface of the piston 16 from the rounded bottom to the string aperture 42.

A significant aspect of the tuning key of the present invention includes a pair of vertically extending plates 45 which are mounted to the upper surface of the radial flange 22. A small circular pulley or guide roller 46 is journaled by a transverse axle 47 which is mounted between the two plates 45. A string is passed under the roller 46, along the axial peripheral groove 48 in the exterior of the tuning piston 16 and through the transverse opening 42 where it is clamped to the piston by screw 43. The roller-like string guide pulley 46 permits the string 13 to be moved and tensioned with a force substantially less than that necessary to overcome the static coefficient of friction which would exist with a string 13 bent over a stationary edge as presented in the prior art. The string 13 directly engages the pulley 46 which uniformly and smoothly transmits string tension along the longitudinal axes of the string segments between the neck piece 12 and the point at which the string is clamped. The string guide pulley permits the rolling transfer of string tensioning forces in a direction parallel to the axes of the string segments at all points along string 13. That is, the axial movement of the tuning piston produces directly transferred string tensioning forces in a direction orthogonal to the direction of movement of the piston. No force produced by piston movement goes untransferred in string tension. A vast improvement in linear tuning keys.

A transverse set screw 49 passes through the wall of the piston housing 19 and extends into and is received by the groove 48 to permit and finally limit axial movement of the piston 16 but to restrain rotational movement thereof.

In operation, the tuning knob 17 is rotated in a direction so as to cause the actuation ram 34 to move the head 35 thereof to the bottom portion of the inner chamber 21 in the piston housing 19. This also lowers the tuning piston 16 in preparation for receiving a string. An instrument string 13 is first passed between the plates 45 and under the pulley 46. The string is then received into the axially extending groove 48 and is bent and passed through the transverse hole 42. The set screw 43 is then tightened to clamp the string 13 rigidly to the tuning piston 16. The tuning knob 17 is rotated to move the actuation ram 34 upwardly and thereby move the tuning piston 16 upwardly. The piston pulls the string upwardly across the pulley 46 and thereby tensions the string 13 to produce the desired resonant tone upon vibration. Rotation of the knob 17 in the opposite direction will similarly lower the tuning piston 16 and thereby reduce the tension on the string and produce a lower frequency of resonance. The tuning knob 17 is knurled on its outer surface to provide reliability of grip.

Figure 3:
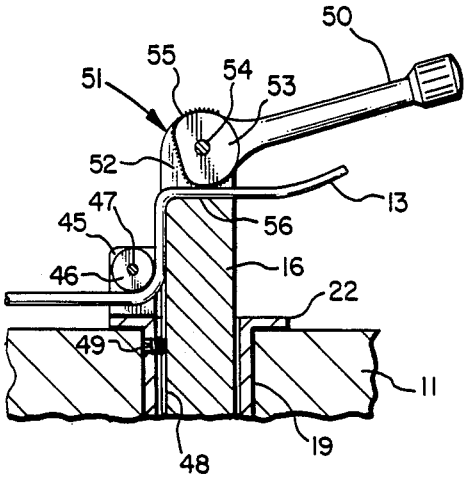
FIG. 3 is a fragmentary longitudinal cross-sectional view of one embodiment of the invention which relates to the manner of affixing a string to the tuning key.
Figure 4:
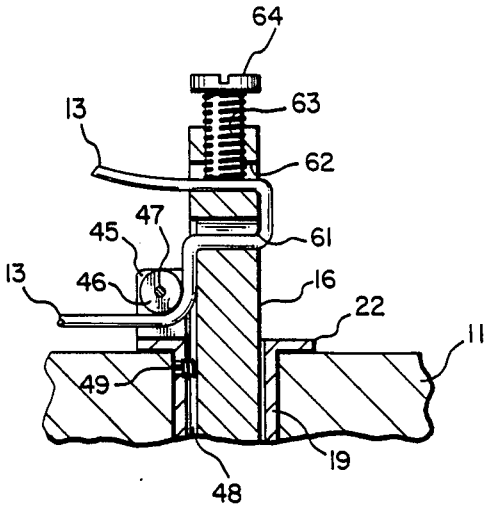
FIG. 4 is a fragmentary longitudinal cross-sectional view of another embodiment of the invention relating to the means for affixing the string to the tuning key.

FIGS. 3 and 4 illustrate alternative means for securing the instrument string to a tuning piston of a key constructed in accordance with the present invention. More particularly, FIG. 3 shows a tuning piston 16 positioned within the cylindrical inner chamber of a piston housing 19 mounted within a peg head 11. The piston 16 includes a longitudinally extending groove 48 into which extends a set screw 49 to prevent rotational movement of the piston while permitting longitudinal movement. The upper end of the tuning piston 16 includes a transversely extending diametrical slot 51 which defines a pair of opposed planar walls 52 between which are positioned an eccentric cam member 53 having an actuation handle 50. The eccentric cam member 53 is journaled to move between the walls 52 upon an axle 54. The exterior eccentric surface of the cam member includes serrations 55. In operation, a string 13 is passed between the plates 45 and across the pulley 46 into the longitudinal groove 48 and between the walls 52. The string 13 passes beneath the cam member 55 while the handle 54 is positioned in a vertical position in general axial alignment with the tuning piston 16. The eccentric provides a space between the serrated exterior surface 55 and the bottom of the slot 52 for the string to freely pass. Thereafter, the handle 50 is moved downwardly to the position shown in FIG. 3 whereby the serrated exterior surface 55 of the eccentric cam 53 engages the surface of the string 13 and clamps it against the bottom surface 56 of the slot 51. As can be seen from FIG. 3, tension in the string produced by vertical movement of the tuning piston 16 serves to cause the eccentric cam to more firmly engage the string and lock it against slippage. The clamp mechanism of FIG. 3 also includes a feature of very rapid attachment of the string 13 to the tuning piston 16 for quick changing of strings, for example, in the event of string breakage during a performance on the instrument.

FIG. 4 also discloses a portion of a peg head 11 through which a piston housing 19 having an upper flange 22 passes. The flange 22 also mounts a pair of upright plates 45 and a string pulley 46 journaled by an axle 47 extending between the plates 45. The piston 16 includes a longitudinally extending groove 48 into which extends for sliding engagement a set screw 49 to prevent rotation of the piston while permitting longitudinal movement thereof. The upper end of the tuning piston 16 includes a pair of longitudinally spaced transversely extending diametrical openings 61 and 62. A threaded axially extending opening 63 extends from the upper end of the tuning piston and intersects the bottom of the upper transverse opening 62. A threaded set screw 64 is received into the opening 63. A string 13 is passed between the plates 45 and across the pulley 46 into the longitudinal groove 48 and transversely through the lower opening 61. The string is bent into a U-shape and then passed in the opposite direction through the upper transverse opening 62 beneath the set screw 64. The screw 64 is then tightened to clamp the string against the bottom of the upper opening 62. The string clamp configuration of FIG. 4 is especially adapted for use with unwound strings which are very difficult to lock rigidly to a tuning ram because of their smaller diameter and lack of friction engagement surface. The double loop technique of the embodiment of the clamp portion of the invention shown in FIG. 4 securely clamps the unwound strings to the tuning piston so that upon axial movement thereof, the string is not subject to creep or other movement with respect to the tuning piston.

Figure 5:
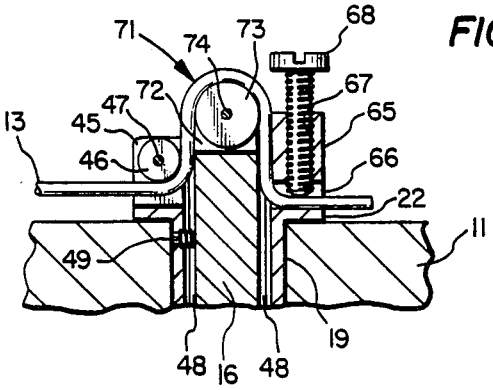
FIG. 5 is a fragmentary longitudinal cross-sectional view of an alternate embodiment of the tuning key of the present invention.

Referring now to FIG. 5, there is shown an additional alternate embodiment of a tuning key constructed in accordance with the invention. There is shown a peg head 11 which mounts a piston housing 19 having a radial flange portion 22 at the upper end thereof positioned adjacent the upper surface of the peg head 11. On one side of the upper surface of the flange 22 is mounted a pair of spaced upstanding walls 45 between which is journaled a first string guide pulley 46 by means of an axle 47. The opposite side of the flange includes a flange block 65 through which is formed a transversely extending string receiving opening 66 which is also in communication with an axially extending threaded opening 67. A set screw 68 is received within the threaded opening 67. The upper end of the tuning piston 16 is bifurcated similar to the upper end of the piston in the embodiment of FIG. 3, and includes a transversely extending slot 71 formed between a pair of opposed parallel walls 72. A second string guide pulley 73 is journaled for rotation between the walls 72 by means of an axle 74. The piston 16 includes a pair of diametrically opposed longitudinally extending grooves 48 into one of which extends a set screw 49 to prevent rotational movement of the ram while permitting longitudinal movement. A string 13 is passed between the plates 45 and under the first guide pulley 46, into the first longitudinal slot 48, across the second string guide pulley 73 into the second longitudinally extending string receiving groove 48 in the piston 16 and through the transverse opening 66 in the flange block 65. The set screw 68 is tightened to clamp the string 13 against the bottom surface of the transverse opening 66. Vertical movement of the tuning piston 16 serves to tension the string 13 with an additional mechanical advantage by virtue of the first and second string guide pulleys 46 and 73 so that a given incremental movement of the tuning piston 16 produces a correspondingly greater change in the tensioning of the string 13.

FIGS. 6 and 7 disclose two additional alternate embodiments of the tuning key of the present invention, each of which feature tuning key actuation knobs which are mounted for rotational movement only and are not axially displaced by rotation. Referring particularly to FIG. 6, there is shown a peg head 11 having a cylindrical opening 18. In the opening 18 is mounted a piston housing 19, the first upper end of which is terminated by a radially extending flange 22 the lower surface of which abuts the upper surface of the peg head 11. The lower second end of the piston housing 19 is externally threaded at 101 and the interior of the inner chamber 102 is narrowed by a transition region 103 to a small clearance opening 104. The piston housing 19 is held within the opening 18 of the peg head 11 by means of flange 22 at the top and a flat circular washer 105 positioned against the lower surface. The washer 105 is clamped to the lower surface of the peg head 11 by means of an internally threaded cylindrical mounting sleeve 106 which engages the exterior threads 101 of the lower end of the housing 19.

The movable tuning piston 16 is generally cylindrical and includes a pair of opposed longitudinally extending exterior grooves 48 into one of which is received a set screw 49 extending through the wall of the piston housing 19. The screw 49 allows longitudinal movement of the piston 16 but not rotational movement thereof. The interior of the piston 16 includes a threaded axial opening 100 which engages the threaded exterior of a drive screw 107. The lower end of the drive screw 107 is fixed to the top of a flanged head 108 of a base screw 109. A retaining circlip 99 encircles the base screw 109 and the lower end of the base screw 109 is threaded into rigid engagement with a central axial hole in the lower end wall of the cap-like tuning knob 17. The interior of the tuning knob 17 includes a cylindrical wall which closely receives the exterior of the mounting sleeve 106 and a flat upper edge surface which closely receives the lower surface of the washer 105. The pitch of the threads on the exterior of the drive screw 107 and the interior of the tuning piston 16 establishes the degree of axial movement of the tuning piston 16 in response to a given angular rotation of the tuning knob 17.

One side of the upper surface of the flange 22 has mounted thereto a pair of spaced upstanding walls 45 between which are journaled a first string guide pulley 46 by means of an axle 47. The upper end of the tuning piston 16 is bifurcated to define a slot 110 extending between a pair of spaced parallel walls 111. Between the walls a second string guide pulley 112 is journaled by means of an axle 113. The portion of the flange opposite the first guide pulley 46 includes a block 114 having a transverse opening 115 at the lower edge thereof and a longitudinally extending threaded opening 116 which intersects the opening 115. A set screw comprises a threaded shank 117 and a pivotal handle 118. The threaded shank 117 is in engagement with the threaded interior of the opening 116.

In operation, a string 13 is threaded between the walls 45 under the first guide pulley 46, into the longitudinal groove 48, across the second guide pulley 112 into the opposite longitudinally extending groove 48 and through the transverse opening 115. The string is first partially tensioned to remove slack and then the set screw 117 is rotated to clamp the string 13 to the bottom of the opening 115. Rotation of the tuning knob 17 rotates the screw 109, the head 108, and the drive screw 107 to rotate within the internally threaded axial opening 100 of the tuning piston 16 to move the piston in an axial direction. Movement of the piston 16 causes the pulley 112 to move and thereby tensions the string 13. The string guide pulleys 46 and 112 allow all string tension forces to be in a direction parallel to the longitudinal axis of the string. It is to be noted that the embodiment of FIG. 6 features a tuning knob which is fixed against other than rotational movements and enables the tensioning of an instrument string by means of vertical movement of a tuning piston without corresponding vertical movement of the tuning knob itself.

Referring now to FIG. 7, there is shown an additional alternate embodiment which also features a longitudinally fixed but rotationally movable tuning knob. The peg head 11 has an opening 18 formed therethrough within which is positioned a piston housing 19 having first and second ends including an upper radially outwardly extending flange 22 and a threaded lower exterior portion 103. The cylindrical inner chamber 102 is narrowed by a conical portion 103 and terminated by an axial clearance opening 104. A washer 105 is clamped against the lower surface of the peg head 11 by means of an internally threaded mounting sleeve 106. The movable tuning piston 16 includes a longitudinally extending groove along the outside 48 into which extends a set screw 49 to prevent rotational movement thereof but allow and limit longitudinal movement. A threaded axial interior opening 100 in the piston 16 is engaged by a drive screw 107 which is part of the enlarged head 108 of a base screw 109. A retaining circlip 99 encircles the base screw 109 the lower end of which is rigidly affixed to a central opening in the lower inside surface of the tuning knob 17. The upper end of the tuning piston 16 includes a transversely extending slot 110 defined by a pair of spaced opposed walls 111 between which are positioned a rotatable second guide pulley 112 journaled upon an axle 113. The upper surface of the radially extending flange 22 includes on one side a pair of parallel vertically spaced walls 45 between which are journaled a first guide pulley 46 on an axle 47. The other side of the flange mounts a block 114 having a transversely extending opening 115 and an axial threaded opening 116 into which is engaged a set screw 117.

A string 13 is threaded between the upstanding walls 45 over the first guide pulley 46 and under the guide pulley 112 positioned in the slot 110 in the upper end of the tuning piston 16. The string thereafter passes through the opening 115 and is clamped by means of the screw 117. Rotation of the tuning knob 17 draws the tuning piston 16 down into the cylindrical inner chamber 102 and thereby tensions the string 13. It is to be noted that in the key design of FIG. 7, longitudinal movement of the piston is also achieved without any movement of the tuning knob other than rotational.

Referring now to FIG. 8 an additional embodiment is illustrated providing an alternative means of mounting the tuning knob 17 to the rest of the novel tuning key of the present invention and for securing the string 13. In particular, in FIG. 8 there is shown a peg head 11 having an opening 18 therein into which is fitted a piston housing 19 having first and second open ends. The lower exterior portion of the piston housing 19 is threaded at 101. The housing 19 is engaged by an internally threaded retaining nut 121 which firmly tightens the washer 105 to the underside of the peg head 11.

The interior of the tuning knob includes a central, axially extending threaded opening 129 which engages the threaded exterior 130 of the lower portion of the tuning piston 131. Rotation of the tuning knob 17 drives the piston 131 in the axial direction. The upper interior portion of the tuning knob 17 includes a cylindrical opening 122 which receives with clearance both the nut 121 and the washer 105. The upper/outer portion of the nut 121 includes a circumferential groove within which is received a circular ring 124 having a rectangular cross-section and smooth outer surface for rotation movement within the groove. The ring 124 includes a plurality of radially inwardly extending sockets 125 which receive set screws 126 extending through openings in the exterior of the knob 17 and which engage the sockets in the rotatable ring 124. Thus, the knob 17 is journaled to rotate about the nut 121 by means of the rotation of the circular ring 124 within the circular peripheral groove 123.

The upper portion of the tuning piston 131 includes a cylindrical shaft 133 having a longitudinal groove 134 therein. The groove 134 receives a set screw 135 which extends through an opening in the wall of the piston housing 19 to restrain rotational movement of the piston while allowing and limiting longitudinal movement thereof. The upper end of the piston shaft 133 is bifurcated and mounts a second string guide pulley 136 on an axle 137. The upper end of the piston housing 19 includes a radially extending flange 22 the lower surface of which abuts the upper surface of the peg head 11. One side of the upper surface of the flange 22 has mounted thereto a pair of upstanding walls 45 between which are mounted a first string guide pulley 46 by means of an axle 47. The portion of the flange opposite the first guide pulley may include the block 114 shown in FIGS. 5, 6, and 7, or the string securing mechanism described in more detail below.

Still referring to FIG. 8 there is shown an alternative embodiment of means for securing the instrument string 13 to the piston housing 19. The string securing apparatus comprises a threaded post 150 having a bifurcated upper portion 152 which projects from the flange 22. The base of the bifurcated section terminates in a curved body portion 154 adapted for receiving the instrument string 13 thereacross. The lower end of the threaded post is secured to the flange 22. A clamping member 156 is provided for receiving the post 150 therethrough in threaded engagement. The clamping member 156 includes an outer cylindrical body portion 158 terminating along a lower, circular edge 160 of narrowed wall thickness. The narrow wall thickness is provided by a tapered inner wall 162 which produces the thin peripheral edge 160 around the base of the clamping member for rotatably engaging and bearing against an instrument string received through the bifurcated section 152. As the clamping member is threaded down upon the post 150, a string 13 received therethrough is sandwiched between the mating members and is securely pinned therebetween relative to the movable tuning piston 16. In this manner, the string end is secured during the axial movement of the piston 16 for the tensioning of the remaining body of the string on the instrument. Such threaded members are economically fabricated and provide enhanced gripping reliability which is required for the tensioning actuation of the present invention.

In operation, a string 13 is threaded between the walls 45 under the first guide pulley 46 across the second guide pulley 136 and under the clamping member 156. The string is first partially tensioned to remove slack and then the string securing mechanism is used to clamp the string 13. Rotation of the tuning knob 17 drives the threaded portion 130 of the tuning screw 133, to move the piston in an axial direction. Movement of the tuning piston 133 causes the pulley 136 to move and thereby tensions the string 13. It is to be noted that the embodiment of FIG. 8 also features a tuning knob which is fixed against other than rotational movements and enables the tensioning of an instrument by means of vertical movement of a tuning piston without corresponding axial movement to the tuning knob itself.

Figure 9:
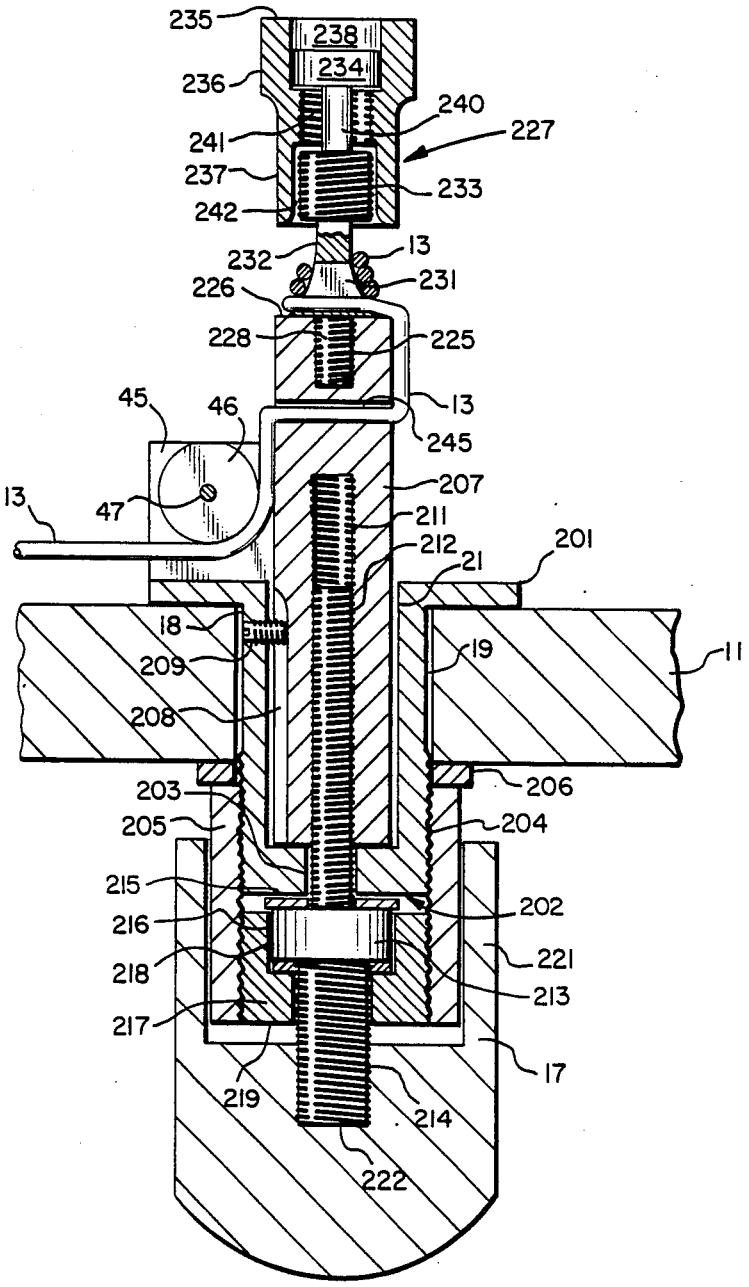
FIG. 9 is a longitudinal cross-section of another embodiment of the present invention.

Referring now to FIG. 9, there is shown a further embodiment for the novel tuning key of the present invention. In this embodiment, the tuning knob also effects axial movement of a tuning piston by means of rotational movement only without any vertical displacement of the knob. As shown, a peghead 11 has an opening 18 formed therethrough into which is fitted a piston housing 19. The piston housing 19 is generally cylindrical having a radially extending flange 201 at the upper end thereof which engages the upper surface of the peghead 11. The housing 19 has a closed lower end 202 including a central clearance aperture 203 formed therein. The outer surface of the lower portion of the piston housing 19 is externally threaded at 204 to receive on internally threaded cylindrical mounting sleeve 205. A cylindrical washer 206 is positioned between the upper edge of the mounting sleeve 205 and the lower surface of the peghead 11 to clamp the piston housing 19 to the peghead between the washer 206 and the radially extending flange 201.

The outer surface of a cylindrical tuning piston 207 is received for axial movement within the cylindrical cavity 21 of the piston housing 19. The tuning piston 207 includes a longitudinally extending groove 208 in the outer surface which receives a set screw 209 extending through the wall of the piston housing 19 to allow and limit vertical movement of the tuning piston 207 while restraining any rotational movement thereof. The tuning piston 207 includes a threaded axial cylindrical passageway 211 which receives an externally threaded drive screw 212. The screw 212 extends through the axial clearance opening 203 in the lower end of the piston housing 19 and has affixed to, or as part of the lower end thereof, a flanged head 213 connected with a base screw 214. The threads on the base screw 214 are preferably formed in the opposite direction from the threads of the upper portion of the drive screw 212.

A frictionless washer includes bearing surfaces 215 and 216 which are positioned below and above the radially extending portions of the flanged head 213 to form bearing surfaces between the flanged head 213 and adjacent parts during rotation of the screws 212 and 214. A cylindrical plug 217 threadedly engages the lower interior of the retaining sleeve 205 and includes an axial opening and a countersunk recessed portion 218 formed in the upper surface for receiving the flanged head 213 of the base screw 214. The lower surface of the plug 217 includes screw slots 219 for ease of installing and removing the plug from within the lower end of the retaining sleeve 205. The cap-like tuning knob 17 has a knurled outer surface and includes a cylindrical wall 221 which closely receives the outer surface of the mounting sleeve 205 for free rotation of the knob 17 thereabout. The tuning knob 17 also includes a central axially extending threaded opening 222 in the lower end wall thereof to receive the threaded outer portion of the base screw 214. The threads of the opening 222 are also formed in the opposite direction from those on the upper portion of the threaded drive screw 212 for ease of installation as will be explained below. Moreover, the tuning knob 17 may also be secured to the base screw threads 214 in a permanent fashion such as by means of epoxy.

The upper surface of the radially extending flange 201 has affixed to one side thereof a pair of upstanding parallel vertically spaced walls 45 between which are journaled a first string guide pulley 46 on a transverse axle 47. The upper end of the cylindrical tuning piston 207 has an axially extending central threaded opening 225 and a generally flat upper end 226. A string clamp mechanism 227 includes a threaded cylindrical lower portion 228 and a somewhat conical string receiving spindle having an enlarged radial portion 231 and a tapering neck portion 232 about which a string 13 is wrapped. The lower portion 228 threadedly engages the opening 225 in the upper end of the piston 207 so that the radial portion 231 abuts the flat upper end 226. Above the neck portion 232 is an enlarged threaded cylindrical slug 233 to the top of which is affixed a narrow cylindrical unthreaded neck portion 240 having an enlarged head 234.

A string clamp knob 235 has a knurled outer portion 236 which tapers to a reduced cylindrical wall 237. The upper interior of the knob 235 includes an enlarged cylindrical recess 238 which receives with clearance the head 234 and joins a threaded central cylindrical portion 241 which engages the external threads 233. The lower interior portion of the knob 235 includes an enlarged cylindrical recess 242 which receives with clearance the threaded cylindrical portion 233. As can be seen, the string clamp mechanism 227 is assembled by first inserting the threaded portion 228 down through the upper cylindrical recess 238 of the knob 236, screwing the threaded portion 233 through the threads 241 until the threaded portion 233 enters the lower cylindrical recess 242. The string clamp mechanism 227 is then attached to the upper end of the tuning piston 207 by screwing the threaded lower portion 228 into the threaded opening 225 so that the radial portion 231 abuts the flat upper end 226. The head 234 retains the string clamp knob 235 and prevents accidental loss thereof.

As shown in FIG. 9, a string 13 passes beneath the first string guide wheel 46 through a transverse opening 245 in the upper end of the tuning piston 207 and is wrapped spirally about the neck portion 232 and any excess cut off. The string clamp knob 235 is then lowered to engage the spirally wrapped string 13 and the internally threaded cylindrical portion 241 engages the externally threaded cylindrical plug 233. Rotation of the clamp knob 235 brings the lower cylindrical recess 242 down over the spirally wound strings in the case of thin string members to enshroud them. The lower edge of the knob 235 presses down against the spirally wrapped string to press the string surfaces together and clamp them to the piston 207.

Once a string has been clamped to the upper end of the tuning piston 207, rotation of the tuning knob 17 causes the tuning piston 207 to move axially in one direction within the tuning piston housing 19 and thereby tension the string 13 to produce a desired pitch upon vibration. Rotation of the tuning knob 17 in the opposite direction effects detensioning of the string. As can be seen, rotation of the tuning knob 17 does not result in any axial translation of the knob 17 but only rotation of the drive screw 212 which effects movement of the tuning piston 207 and thereby tuning of the string.

Figure 10:
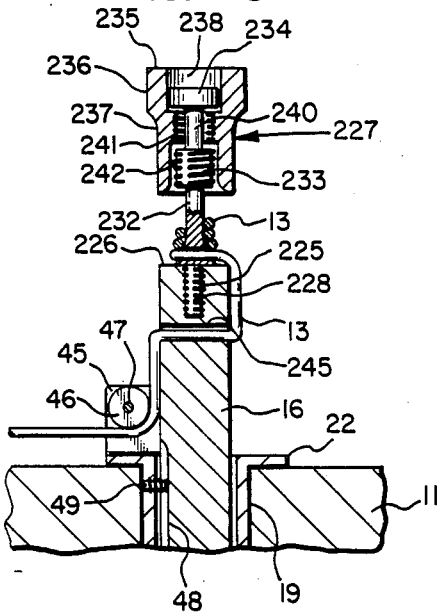
FIG. 10 is a fragmentary longitudinal embodiment of an alternative means for affixing a string to the tuning key.

Referring now to FIG. 10, there is shown another embodiment of a tuning key structure of the type described above in connection with the drive mechanism of FIG. 2 and the alternative string clamp mechanisms of FIGS. 3 and 4 and having a further alternative embodiment of string clamp mechanism. As shown, a tuning piston 16 moves within a piston housing 19 mounted within a peghead 11 of a stringed instrument. A radially extending flange 22 abuts the upper surface of the peghead and has mounted to one side thereof a pair of spaced parallel vertical plates 45 having a guide pulley 46 mounted therebetween upon an axle 47. The tuning piston 16 includes a longitudinally extending groove 48 into which extends a set screw 49 which passes through the side of the housing 19 to prevent rotational movement of the piston while allowing and limiting axial movement thereof. The upper portion of the tuning piston 16 includes a transversely extending diametrical slot 245.

A string clamp mechanism 227 includes a threaded cylindrical lower portion 228 and a somewhat conical string receiving spindle having an enlarged radial pedestal portion 231 and a tapering neck portion 232 about which a string 13 is wrapped. The lower portion 228 threadedly engages the opening 225 in the upper end of the piston so that the radial portion 231 abuts the flat upper end 226. Above the neck portion 232 is an enlarged threaded cylindrical slug 233 to the top of which is affixed a narrow cylindrical unthreaded neck portion 240 having an enlarged head 234.

A string clamp knob 235 has a knurled outer portion 236 which tapers to a reduced cylindrical wall 237. The upper interior of the knob 235 includes an enlarged cylindrical recess 238 which receives with clearance the head 234 and joins a threaded central cylindrical portion 241 which engages the external threads 233. The lower interior portion of the knob 235 includes an enlarged cylindrical recess 242 which receives with clearance the threaded cylindrical portion 233. As can be seen, the string clamp mechanism 227 is assembled by first inserting the threaded portion 228 down through the upper cylindrical recess 238 of the knob 235, screwing the threaded portion 233 through the threads 241 until the threaded portion 233 enters the lower cylindrical recess 242. The string clamp mechanism 227 is then attached to the upper end of the tuning piston 16 by screwing the threaded lower portion 228 into the threaded opening 225 so that the radial portion 231 abuts the flat upper end 226. The head 234 retains the string clamp knob 235 and prevents accidental loss thereof.

As shown in FIG. 10, a string to be tuned 13 passes beneath the first string guide wheel 46 through the transverse opening 245 in the upper end of the tuning piston 16 and is wrapped spirally about the neck portion 232 and any excess cut off. The string clamp knob 235 is then lowered to engage the spirally wrapped string 13 and the internally threaded cylindrical portion 241 engages the externally threaded cylindrical slug 233. Rotation of the clamp knob 235 brings the lower cylindrical recess 242 down over the spirally wound strings in the case of thin string members to enshroud them. The lower edge of the knob 235 presses down against the spirally wrapped string to press the string surfaces together and clamp them to the piston 16 and the end of the string is then cut off.

Figure 11:
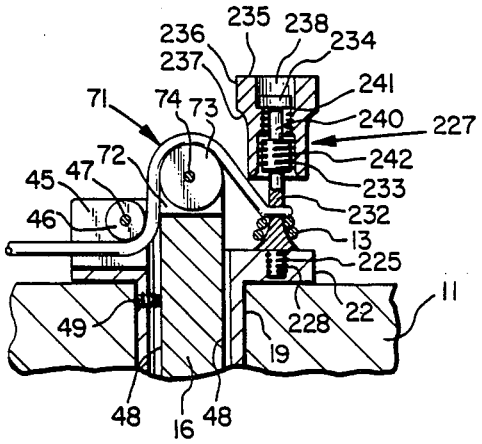
FIG. 11 is a fragmentary longitudinal embodiment of an additional alternative means for affixing a string to the tuning key.

A similar alternative embodiment of string clamp mechanism in a double pulley tuning key constructed in accordance with the invention is shown in FIG. 11. There is shown a peghead 11 having an axial opening therein into which is received a piston housing 19 which receives a tuning piston 16. The tuning piston 16 has a pair of axially extending peripheral slots 48 one of which receives ,a set screw 49 to prevent rotational movement of the tuning piston while allowing and limiting longitudinal movement thereof. A radially extending flange 22 mounts on one side thereof a pair of vertically extending spaced plates 45 between which is journaled a guide wheel 46 on an axle 47. The upper end of the tuning piston 16 is bifurcated similar to the upper end of tuning piston of the embodiment of FIG. 5 and includes a transversely extending slot 71 formed between a pair of opposed parallel walls 72. A second string guide pulley 73 is journaled for rotation between the walls 72 by means of an axle 74.

The string clamp mechanism 227 includes a threaded cylindrical lower portion 228 and a somewhat conical string receiving spindle having an enlarged radial pedestal portion 231 and a tapering neck portion 232 about which a string 13 is wrapped. The lower portion 228 threadedly engages an opening 225 in the upper surface of the flange 22 so that the radial portion 231 abuts the flat upper surface. Above the neck portion 232 is an enlarged threaded cylindrical slug 233 to the top of which is affixed a narrow cylindrical unthreaded neck portion 240 having an enlarged head 234.

A string clamp knob 235 has a knurled outer portion 236 which tapers to a reduced cylindrical wall 237. The upper interior of the knob 235 includes an enlarged cylindrical recess 238 which receives with clearance the head 234 and joins a threaded central cylindrical portion 241 which engages the external threads 233. The lower interior portion of the knob 235 includes an enlarged cylindrical recess 242 which receives with clearance the threaded cylindrical portion 233. As can be seen, the string clamp mechanism 227 is assembled by first inserting the threaded portion 228 down through the upper cylindrical recess 238 of the knob 235, screwing the threaded portion 233 through the threads 241 until the threaded portion 233 enters the lower cylindrical recess 242. The string clamp mechanism 227 is then attached to the upper end of the piston housing 19 by screwing the threaded lower portion 228 into the threaded opening 225 so that the radial portion 231 abuts the flat upper surface. The head 234 retains the string clamp knob 235 and prevents accidental loss thereof.

As shown in FIG. 11., a string to be tuned 13 passes beneath the first string guide pulley 46 across the second string guide pulley 73 and is wrapped spirally about the neck portion 232 and any excess cut off. The string clamp knob 235 is then lowered to engage the spirally wrapped string 13 and the internally threaded cylindrical portion 241 engages the externally threaded cylindrical slug 233. Rotation of the clamp knob 235 brings the lower cylindrical recess 242 down over the spirally wound strings in the case of thin string members to enshroud them. The lower edge of the knob 235 press down against the spirally wrapped string to press the string surfaces together and clamp them to the piston housing 19.

Figure 12:
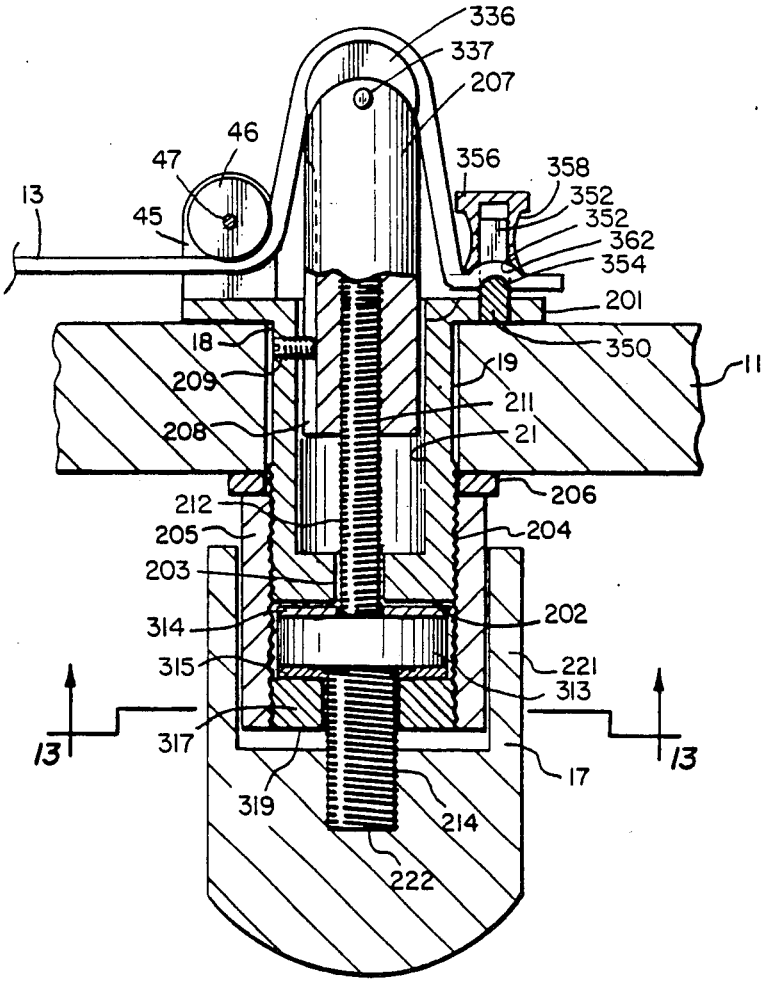
FIG. 12 is a longitudinal cross-section of another embodiment of the construction of the tuning key of the present invention.

Referring now to FIG. 12, there is shown another embodiment for the novel tuning key of the present invention. In this embodiment, the tuning knob also effects axial movement of a tuning piston by means of rotational movement only without any vertical displacement of the knob. As shown, a peghead 11 has an openin9 18 formed therethrough into which is fitted a piston housing 19. The piston housing 19 is generally cylindrical having a radially extending flange 201 at the upper end thereof which engages the upper surface of the peghead 11. The housing 19 has a closed lower end 202 including a central clearance aperture 203 formed therein. The outer surface of the lower portion of the piston housing 19 is externally threaded at 204 to receive an internally threaded cylindrical mounting sleeve 205. A cylindrical washer 206 is positioned between the upper edge of the mounting sleeve 205 and the lower surface of the peghead 11 to clamp the piston housing 19 to the peghead between the washer 206 and the radially extending flange 201.

The outer surface of a cylindrical tuning piston 207 is received for axial movement within the cylindrical cavity 21 of the piston housing 19. The tuning piston 207 includes a longitudinally extending groove 208 in the outer surface which receives a set screw 209 extending through the wall of the piston housing 19 to allow and limit vertical movement of the tuning piston 207 while restraining any rotational movement thereof. The tuning piston 207 includes a threaded axial cylindrical passageway 211 which receives an externally threaded drive screw 212. The screw 212 extends through the axial clearance opening 203 in the lower end of the piston housing 19 and has affixed to, or as part of the lower end thereof, a radially extending disk member 313 connected with a base screw 214. The radially extending upper and lower surfaces of the disk member 313 are each in opposed facing relationship with generally flat adjacent surfaces for frictional engagement therewith as set forth below. The disk member 313 may be formed of a leaded-bronze bearing material. The threads on the base screw 214 are preferably formed in the opposite direction from the threads of the upper portion of the drive screw 212.

A first frictionless washer 314 is positioned above the radially extending portions of the disk member 313 and a second washer 315 is positioned below to form bearing surfaces between the disk member 313 and adjacent parts during rotation of the screws 212 and 214. The washers 314 and 315 produce a more finely regulatable force of frictional engagement between the surface of the disk member 313 and its opposed facing surfaces. The washers 314 and 315 may be made of a material such as those sold under the tradenames of Teflon or Rulon. Bearing surfaces may be unnecessary where the disk 313 is made of a material with high lubricity, such as leaded-bronze.

Figure 13:
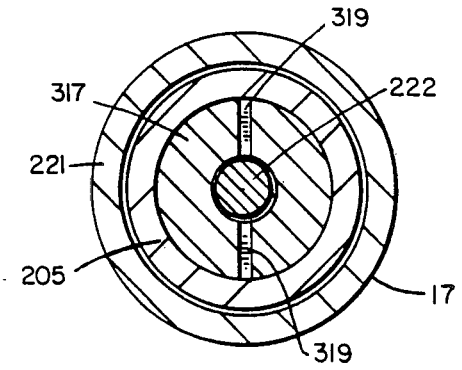
FIG. 13 is a cross-section view of the tuning key shown in FIG. 12 taken about the lines 13—13.

A cylindrical plug 317 threadedly engages the lower interior of the retaining sleeve 205 and includes a central axial opening and an upper surface for engaging the lower surface of the disk member 313 adjacent the washer 315. As shown in FIG. 13, the lower surface of the plug 317 includes diametrically extending slots 319 for receiving a tool blade and assisting in the installation, adjustment, and removal of the plug within the lower end of the retaining sleeve 205.

By rotating the plug 317, its axial position is varied to squeeze the disk member 313 between the lower end 202 of the housing 19 and the upper surface of the plug 317. The frictionless washers 314 and 315 facilitate rotation of the disk 313 against varying amounts of rotation resisting torque as the plug 317 is adjusted. This allows the string tension adjusting torque of the tuning key to be changed as desired. The frictional engagement with the disk 313 prevents undesired axial movement of the tuning piston so that string vibration does not cause the tuning piston to back down and detune the instrument.

The cap-like tuning knob 17 has a knurled outer surface and includes a cylindrical wall 221 which closely receives the outer surface of the mounting sleeve 205 for free rotation of the knob 17 thereabout. The tuning knob 17 also includes a central axially extending threaded opening 222 in the lower end wall thereof to receive the threaded outer portion of the base screw 214. The threads of the opening 222 are also formed in the opposite direction from those on the upper portion of the threaded drive screw 212 for ease of installation after adjustment of the plug 319 has been effected.

It should be understood that a resilient O-ring may be included as a sealing means between the inside wall 221 of the knob 17 and the outer surface of the sleeve 205 within a circumferential groove therein for damping extraneous vibrations and enclosing the interior of the knob against foreign materials.

The upper surface of the radially extending flange 201 has affixed to one side thereof a pair of upstanding parallel vertically spaced walls 45 between which are journaled a first string guide pulley 46 on a transverse axle 47. The upper end of the cylindrical tuning piston 207 is bifurcated and mounts a second string guide pulley 336 on an axle 337.

The string securing apparatus comprises a threaded post 350 having a bifurcated upper portion 352 which projects from the flange 201. The base of the bifurcated section terminates in a curved body portion 354 adapted for receiving the instrument string 13 thereacross. The lower end of the threaded post 350 is secured to the flange 201. A clamping member 356 is provided for receiving the post 350 therethrough in threaded engagement. The clamping member 356 includes an outer cylindrical body portion 358 terminating along a lower, circular edge 360 of narrowed wall thickness. The narrow wall thickness is provided by a tapered inner wall 362 which produces the thin peripheral edge 360 around the base of the clamping member for rotatably engaging and bearing against an instrument string 13 received through the bifurcated section 352. As the clamping member is threaded down upon the post 350, a string 13 received therethrough is sandwiched between the mating members and is securely pinned therebetween relative to the movable tuning piston 207. In this manner, the string end is secured during the axial movement of the piston 207 for the tensioning of the remaining body of the string on the instrument. Such threaded members are economically fabricated and provide enhanced gripping reliability which is required for the tensioning actuation of the present invention.

In operation, a string 13 is threaded between the walls 45 under the first guide pulley 46 across the second guide pulley 336 and under the clamping member 356. The string is first partially tensioned to remove slack and then the string securing mechanism is used to clamp the string 13. Rotation of the tuning knob 17 drives the tuning screw 212, to move the piston 207 in an axial direction. Movement of the tuning piston 207 causes the pulley 336 to move and thereby tensions the string 13. The frictional engagement between the radially extending surfaces of the disk member 313 and their opposing surfaces, adjusted by rotation of plug 317, determines the amount of torque necessary to rotate the tuning knob 17 and change the tension in the string. Rotation of the tuning knob 17 effects vertical movement of the tuning piston 207 without corresponding axial movement of the tuning knob itself.

As can be seen, the various embodiments of the present invention overcome many of the structural shortcomings of prior art linear movement tuning keys. It is thus believed that the operation and construction of the present invention will be apparent from the foregoing description. While the apparatus shown and described has been characterized as being preferred, it will be obvious that various changes and modifications may be made therein without departing from the spirit and scope of the invention as defined in the following claims.

What is claimed is:

1. A tuning key for a stringed musical instrument having a peg head with apertures therein, comprising:

a generally cylindrical piston housing including an elongate inner cavity having a first open end with a radially extending flange and a second end having an opening therein and an exterior surface a portion of which is threaded;

a tuning piston positioned for axial movement within the inner cavity of said piston housing, said piston having an upper end protruding from the flanged open end of the cavity and a threaded lower end extending through the second end of the cavity;

a retaining nut having a central threaded opening in engagement with the threaded exterior of the said piston housing to clamp the housing within an aperture in the instrument peg head between the radial flange of the piston housing and the upper surface of the nut, said nut having a circular circumferential groove formed in the periphery thereof;

a circular ring positioned for rotation in the circumferential groove of said retaining nut;

a first guide roller rotatably mounted on an axle parallel to the radially extending flange of the piston housing to receive and rotationally guide an instrument string into engagement with the upper end of the tuning piston for direct transfer of tensioning forces therealong;

means for securing an end of said instrument string relative to said tuning piston wherein axial movement of said piston imparts movement of said string across said guide roller;

a cap-like cylindrical tuning knob having an open end and a closed end, the open end having edges which abut the lower surface of the peg head and outer walls which receive the retaining nut with clearance therebetween, said knob having a threaded axial opening for receiving the lower end of the tuning piston; and means for rigidly mounting the inside walls of the open end of the tuning knob to the circular ring to permit rotation of the knob about the retaining nut and move the tuning piston in the axial direction to tension a string.

2. A tuning key for a stringed musical instrument as set forth in claim 1 wherein said securing means includes;

a second string guide pulley mounted for rotation upon an axle fixed to the upper end of said tuning piston and extending transversely thereof for rotationally guiding a string upon axial movement of said piston; and means for clamping an end of said string to a point on the radially extending flange of said piston housing opposite said first string guide pulley.

3. A tuning key for a stringed musical instrument as set forth in claim 1 wherein said securing means includes a transverse diametric opening in the upper end of said piston for receiving a string and a threaded axial opening within which is positioned a set screw for clamping the string within the transverse opening against the bottom thereof.

4. A tuning key for a stringed musical instrument as set forth in claim 1 wherein said tuning piston has a longitudinally extending groove in the exterior surface thereof and which also includes:

a set screw extending through the side wall of said piston housing into the longitudinal groove in said tuning piston to allow longitudinal movement while restraining rotational movement thereof.

5. A tuning key as set forth in claim 1 wherein the tuning piston includes a generally flat upper end having a threaded central opening therein and wherein said instrument string securing means comprises:

an elongate body having a threaded cylindrical lower portion recessed into the threaded central opening in the piston and a string receiving spindle having a lower radially extending pedestal abutting the upper end of said piston and being joined at the upper portion to a threaded cylindrical slug which is connected to an enlarged head by a narrow neck portion, the head being of greater diameter than the slug; and a clamp knob having a central axial opening including an upper cylindrical recess, an intermediate threaded cylindrical portion and a lower cylindrical recess and being positioned upon said elongate body by passage of the body down through the central axial opening so that the threaded slug engages the intermediate portion to apply clamping pressure against an instrument string wrapped spirally thereabout upon rotation of the clamp knob and be retained upon the body by inability of the enlarged head of the body to pass through the intermediate cylindrical portion.

6. A tuning key for a stringed musical instrument having a peg head with apertures therein, comprising:

a generally cylindrical piston housing including an elongate inner cavity having a first open upper end with a radially extending flange and a second lower closed end with a flat lower surface and having an opening therein, the exterior cylindrical surface of the second end of said housing also being threaded;

a tuning piston positioned for axial movement within the inner cavity of said piston housing, said piston having an upper end protruding from the flanged open end of the cavity, a lower end within the cavity and a threaded axial opening;

an drive screw having first and second ends, the first end being threaded and in engagement with the axial opening in said piston and the second end extending through the opening in the second end of said housing and having affixed thereto a radially extending disk member including upper and lower surfaces and a threaded base screw, the upper surface of said disk member being in opposed facing relationship with the flat lower surface of the closed end of the piston housing;

a cylindrical mounting sleeve having internal threads with the upper portion of the threads in engagement with the threaded exterior of the second end of the housing to clamp the housing into an aperture in the instrument peg head between the radial flange of the piston housing and the upper edge of the mounting sleeve;

a cylindrical plug having a threaded exterior and a central axial opening, said plug being positioned in the lower portion of said sleeve and having an upper surface in opposed facing relationship with the lower surface of said radially extending disk member and receiving the threaded base screw of said drive screw through the central axial opening with clearance, said plug being rotationally movable in the axial direction to vary the force of engagement between the upper and lower surfaces of the disk member and the adjacent opposed facing surfaces thereto in order to change the torque required to rotate the actuation ram;

a first string guide pulley journaled upon an axle mounted parallel to the radially extending flange of the piston housing and mounted thereto to receive and rotationally guide an instrument string into engagement with the upper end of the tuning piston for direct transfer of tensioning forces therealong;

means for securing an end of said instrument string relative to said tuning piston wherein axial movement of said piston imparts movement to said string across said guide roller;

a cap-like cylindrical tuning knob having an open end and a closed end with inner walls which overlie and closely receive the outer walls of the mounting sleeve, the central inner portion of the tuning knob having a central axial threaded opening in tight threaded engagement with the base screw of the drive screw to rotate the first end of the drive screw and thereby effect axial movement of the tuning piston for tensioning an instrument string coupled thereto.

7. A tuning key for a stringed musical instrument as set forth in claim 6 wherein the threads formed on the first end of the drive screw are in the opposite direction from the threads formed on the base screw and the central axial opening in the tuning knob.

8. A tuning key for a stringed musical instrument as set forth in claim 6 which also includes a frictionless washer positioned between the upper and lower surfaces of the radially extending disk member and the adjacent opposed facing surfaces thereto to facilitate rotation of said disk member against resisting frictional forces.

9. A tuning key for a stringed musical instrument as set forth in claim 6 wherein the outer surface of said mounting sleeve includes a groove formed circumferentially thereabout and which also includes:

an O-ring formed of resilient material positioned within the circumferential groove in the mounting sleeve to seal against the inner walls of the tuning knob for damping vibration and enclosing the interior of the knob against foreign material.

10. A tuning key for a stringed musical instrument as set forth in claim 6 wherein said tuning piston has a longitudinally extending groove in the exterior surface thereof and which also includes:

a set screw extending through the side wall of said piston housing into the longitudinal groove in said tuning piston to allow longitudinal movement while restraining rotational movement thereof.

11. A tuning key for a stringed musical instrument as set forth in claim 6 wherein said securing means includes;

a second string guide pulley mounted for rotation upon an axle fixed to the upper end of said tuning piston and extending transversely thereof for rotationally guiding a string upon axial movement of said piston; and mean for clamping an end of said string to a point on the radially extending flange of said piston housing opposite said first string guide pulley.

12. A tuning key for a stringed musical instrument as set forth in claim 6 wherein said cylindrical plug includes:

a diametrically extending slot for receiving a tool to assist in the rotation of said plug for adjusting the force of engagement between the surfaces of the disk member and its opposed facing surfaces.

13. A tuning key for a stringed musical instrument as set forth in claim 6 which also includes:

a frictionless washer positioned in the region between a surface of said disk member and an opposed facing surface to produce a more finely regulatable force of frictional engagement therebetween.

* * * * *